US008109334B2

(12) United States Patent
Goodwin

(10) Patent No.: US 8,109,334 B2
(45) Date of Patent: Feb. 7, 2012

(54) SAMPLING AND EVALUATION OF SUBTERRANEAN FORMATION FLUID

(75) Inventor: Anthony R. H. Goodwin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 281 days.

(21) Appl. No.: 12/501,903

(22) Filed: Jul. 13, 2009

(65) Prior Publication Data

US 2011/0005745 A1 Jan. 13, 2011

(51) Int. Cl.
*E21B 49/08* (2006.01)
*E21B 47/00* (2006.01)

(52) U.S. Cl. ..... 166/264; 166/250.01; 166/302; 73/152.24

(58) Field of Classification Search ..... 166/250.01, 166/250.07, 264, 302, 303; 73/152.13, 152.18, 73/152.23, 152.55
See application file for complete search history.

(56) References Cited

U.S. PATENT DOCUMENTS

| | | | | |
|---|---|---|---|---|
| 3,351,132 | A | 11/1967 | Dougan et al. | |
| 4,547,691 | A | 10/1985 | Valdois et al. | |
| 5,394,345 | A | 2/1995 | Berard et al. | |
| 5,622,223 | A * | 4/1997 | Vasquez | 166/264 |
| 6,789,937 | B2 | 9/2004 | Haddad et al. | |
| 6,879,166 | B2 | 4/2005 | May et al. | |
| 6,905,241 | B2 | 6/2005 | Zazovsky et al. | |
| 6,964,301 | B2 | 11/2005 | Hill et al. | |
| 7,002,142 | B2 | 2/2006 | Mullins et al. | |
| 7,075,063 | B2 | 7/2006 | Dong et al. | |
| 7,114,562 | B2 | 10/2006 | Fisseler et al. | |
| 7,379,180 | B2 | 5/2008 | Vannuffelen et al. | |
| 7,445,043 | B2 | 11/2008 | Mullins et al. | |
| 2007/0119244 | A1 | 5/2007 | Goodwin et al. | |
| 2008/0066536 | A1 | 3/2008 | Goodwin et al. | |
| 2008/0066904 | A1 * | 3/2008 | Van Hal et al. | 166/250.1 |
| 2008/0078581 | A1 | 4/2008 | Goodwin et al. | |
| 2008/0093078 | A1 | 4/2008 | Vasques et al. | |
| 2008/0223579 | A1 | 9/2008 | Goodwin | |
| 2008/0257036 | A1 | 10/2008 | Chaudoreille et al. | |
| 2009/0008079 | A1 | 1/2009 | Zazovsky et al. | |

(Continued)

FOREIGN PATENT DOCUMENTS

WO WO9518366 7/1995

(Continued)

OTHER PUBLICATIONS

Proett, Mark A. et al., New Wireline Formation Testing Tool With Advanced Sampling Technology, Apr. 2001, SPE Reservoir Evaluation & Engineering, SPE 71317 pp. 76-87.

(Continued)

*Primary Examiner* — David J. Bagnell
*Assistant Examiner* — Richard Alker
(74) *Attorney, Agent, or Firm* — David J. Smith

(57) ABSTRACT

A method of sampling a subterranean formation fluid may comprise extracting a first fluid sample from a portion of the subterranean formation, altering a temperature of the portion of the subterranean formation, and extracting a second fluid sample from the portion of the subterranean formation having altered temperature. The temperature of the portion of the subterranean formation may be altered based on the relative position of a subterranean formation fluid temperature and the multiphase region envelope in the phase diagram of the subterranean formation fluid. The method may further comprise determining a property of the subterranean formation fluid.

23 Claims, 9 Drawing Sheets

U.S. PATENT DOCUMENTS

2009/0078412 A1 3/2009 Kanayamaya et al.

FOREIGN PATENT DOCUMENTS

| | | |
|---|---|---|
| WO | WO2007048991 | 5/2007 |
| WO | WO2008087156 | 7/2008 |
| WO | WO2008150825 | 12/2008 |
| WO | WO2009/052235 | 4/2009 |

OTHER PUBLICATIONS

Dong, Chengli et al., New Downhole Fluid Analyzer Tool for Improved Reservoir Characterization, SPE 108566, Sep. 4-7, 2007, Aberdeen, Scotland.

* cited by examiner

SAMPLING AND EVALUATION OF SUBTERRANEAN FORMATION FLUID

BACKGROUND OF THE DISCLOSURE

In many well applications, downhole fluid samples are collected for analysis. For example, fluid samples may be collected for reservoir characterization. More specifically, fluid samples may be collected to deduce formation fluid properties. The information derived from the formation fluid properties may be used to facilitate the evaluation of reservoir reserves and/or the planning or optimization of reservoir production, among other things.

Fluid sample properties and/or chemical compositions may be better determined from a fluid sample that has been maintained in single phase. Descriptions of methods or apparatus that may be used to maintain a formation fluid in single phase during extraction from a subterranean formation and/or during sample capture may be found, for example, in U.S. Pat. No. 3,351,132 and PCT Patent Application Pub. Nos. 95/18366 and 2008/087156, the disclosures of which are incorporated herein by reference.

Downhole tools have been employed to obtain fluid samples. In certain prior art apparatus, fluids have been extracted from subterranean formations by sealing off a portion of a wall of the well, and reducing the pressure in the sealed off portion to promote fluid flow from the subterranean formations into the downhole tool. Flow conditions, such as the permeability of the fluid through the formation, as well as the pressure, volumetric flow rate, and temperature, may be measured with such apparatus. A description of examples of such downhole tools may be found in "*New Wireline Formation Testing Tool With Advanced Sampling Technology*" by M. A. Proett, G. N. Gilbert, W. C. Chin, and M. L Monroe, SPE 71317, April 2001, U.S. Pat. No. 7,445,043, and U.S. Patent Application Pub. No. 2008/0066536, the disclosures of which are incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
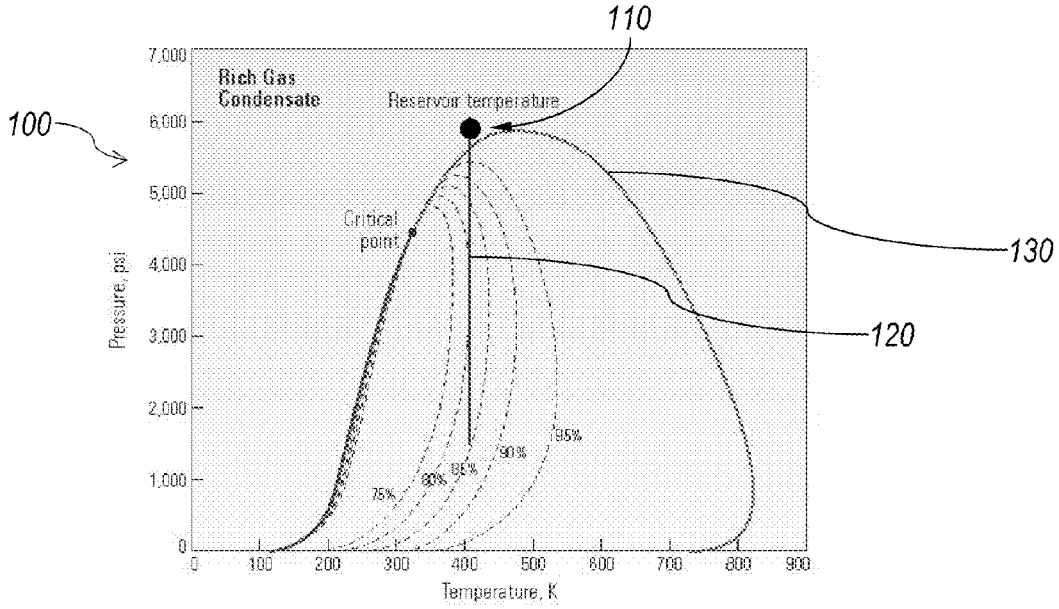
FIG. 1A (PRIOR ART)
FIGS. 1A and 1B are known graphs of phase diagrams of formation fluids.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Methods and apparatus for extracting and optionally evaluating a fluid sample that may be representative of the fluid in a subterranean formation are disclosed herein. For example, the methods and apparatus of the present disclosure may be used to extract at least one fluid sample in single phase, and evaluate the at least one single phase sample.

Although surface, subterranean or subsea samples of both gas and liquid phases may be extracted from a tubing used to convey well fluid to a desired location, these gas and liquid samples may require recombination into a single phase fluid in the correct proportions prior to evaluation. Errors in any of the extraction and recombination processes may result in errors in measured physical properties and/or chemical composition of the recombined fluid, that is, the measured properties and/or composition may not represent those of the subterranean formation fluid. For example, surface or subsea samples may be affected by production conditions prior to or during sampling. Surface or subsea samples may provide samples comprising a mixture of fluids from several producing zones. Different zones may produce fluids at unknown rates and having different properties or compositions. Thus, the recombination of gas and liquid samples in the correct proportions to obtain physical properties or chemical composition representative of the subterranean formation fluid from one producing zone may prove difficult. Differences in measured properties or composition between the sampled fluid and subterranean formation fluid that may arise may lead to an incorrect assessment of the subterranean formation fluid. For example, a gas condensate may be categorized as a volatile oil, or vice versa. Consequently, a facility inappropriate for the subterranean formation fluid to be produced may be designed.

In contrast, a sampling tool may be lowered in a wellbore penetrating the subterranean formation. The wellbore may be a cased or an open-hole wellbore. One or more fluid samples may be admitted into the sampling tool, for example using a fluid extraction device disposed in the sampling tool. Fluid samples may be collected from the wellbore or from a portion of the subterranean formation.

Figure 1B:
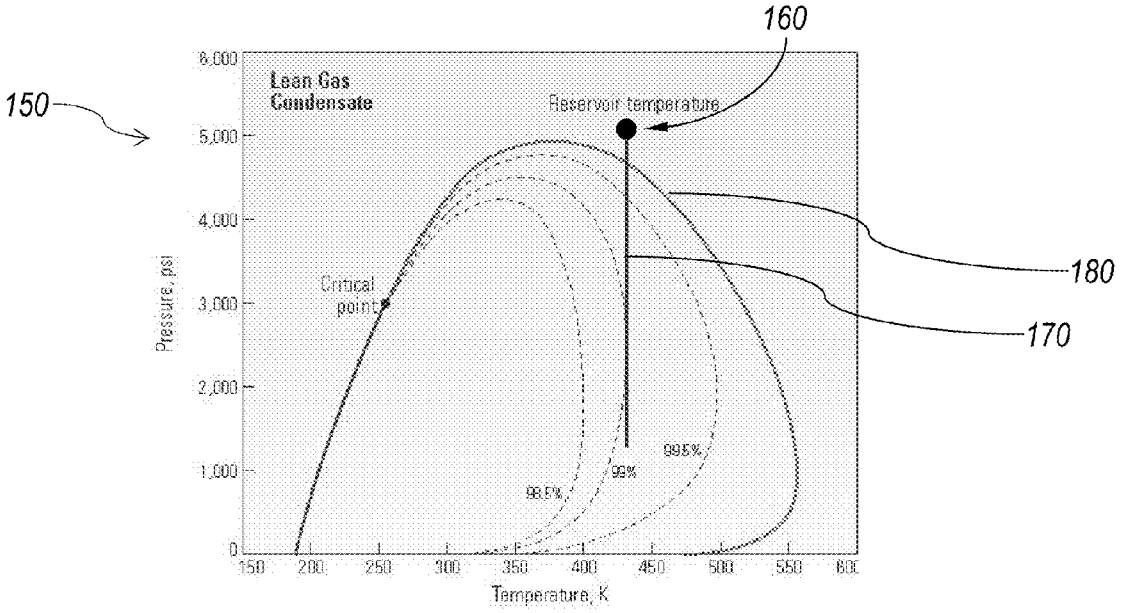
FIG. 1B (PRIOR ART)

Regardless of whether the fluid is collected from the wellbore or the subterranean formation, a single phase fluid sample may be obtained when the pressure and temperature conditions of the subterranean formation fluid are predominantly maintained out of a multiphase region of the fluid phase diagram as the fluid transits from the subterranean formation into the sampling tool. In contrast, FIGS. 1A and 1B illustrate a sampling process where the sampled fluid exhibits a phase transition. FIGS. 1A and 1B show pressure temperature sections of phase diagrams 100 and 150 for, respectively, a rich and a lean gas condensate. In FIGS. 1A and 1B, vertical lines 120 and 170 represent a pressure reduction pathway that may be experienced during a sampling process which utilizes a pressure reduction at formation temperature to induce fluid flow from the formation and/or a pressure drop to move fluid into the sampling tool tubulars. While gas condensates are typically single-phase fluids at formation temperature and pressure (as indicated by points 110 and 160), the difference between the phase transition boundary (e.g., dew curves 130 and 180) and the formation pressure may be such that the sampling process results in a phase transition within the sampling tool, the wellbore and/or a portion of the formation close to the wellbore. In these cases, liquid may segregate in the formation pores, in the bottom of the wellbore and/or in the sampling tool components. Thus, the captured sample may have physical properties and/or a chemical composition unrepresentative of the subterranean formation fluid.

For the purpose of clarity and brevity, sampling tools, such as used in formation evaluation, and methods of use thereof are described hereinafter. However, other types of fluid sampling tools, such as used in production logging, may also be used within the scope of the present disclosure. The sampling tools may be conveyed by wire-line, drill-pipe, coil tubing, or any other means conventional or future-developed in the industry. A method of sampling a subterranean formation fluid may comprise extracting a first fluid sample from a portion of the subterranean formation, altering a temperature of the portion of the subterranean formation (e.g., the portion of the subterranean formation close to an inlet of the sampling tool), and extracting a second fluid sample from the portion of the subterranean formation having altered temperature. Altering the temperature of the portion of the subterranean formation may comprise increasing and/or decreasing the temperature of the subterranean formation, for example, for a predetermined duration. Increasing or decreasing the temperature of the portion of the subterranean formation may facilitate obtaining a single phase sample of subterranean formation fluid. For example, increasing or decreasing the temperature of the portion of the subterranean formation may prevent a pressure reduction pathway that may be experienced during a sampling process from entering a multiphase region of the subterranean formation fluid. In some cases, the temperature variation of the portion of the subterranean formation may be determined for moving the pressure reduction pathway away from the multiphase region envelope in the phase diagram of the formation fluid. Thus, the temperature of the portion of the subterranean formation may be altered based on the relative position of a subterranean formation fluid pressure/temperature and the multiphase region envelope in the phase diagram of the subterranean formation fluid. The method may further comprise determining a property of the formation fluid. Indeed, determining formation fluid properties may be an important part of reservoir evaluation. For example, the ratio of the volume of liquid hydrocarbon to the volume of gas produced during expansion of gas condensates, usually referred to as the condensate-to-gas ratio (CGR), may be important for estimating the economic return on investment of exploitation of a gas condensate reservoir, and/or for determining the capacity need of the surface processing equipment or the reservoir. Also, the CGR (or other composition data) may be used to identify compositional gradients within the reservoir, zones of differing composition, and/or compartmentalization.

Figure 2:
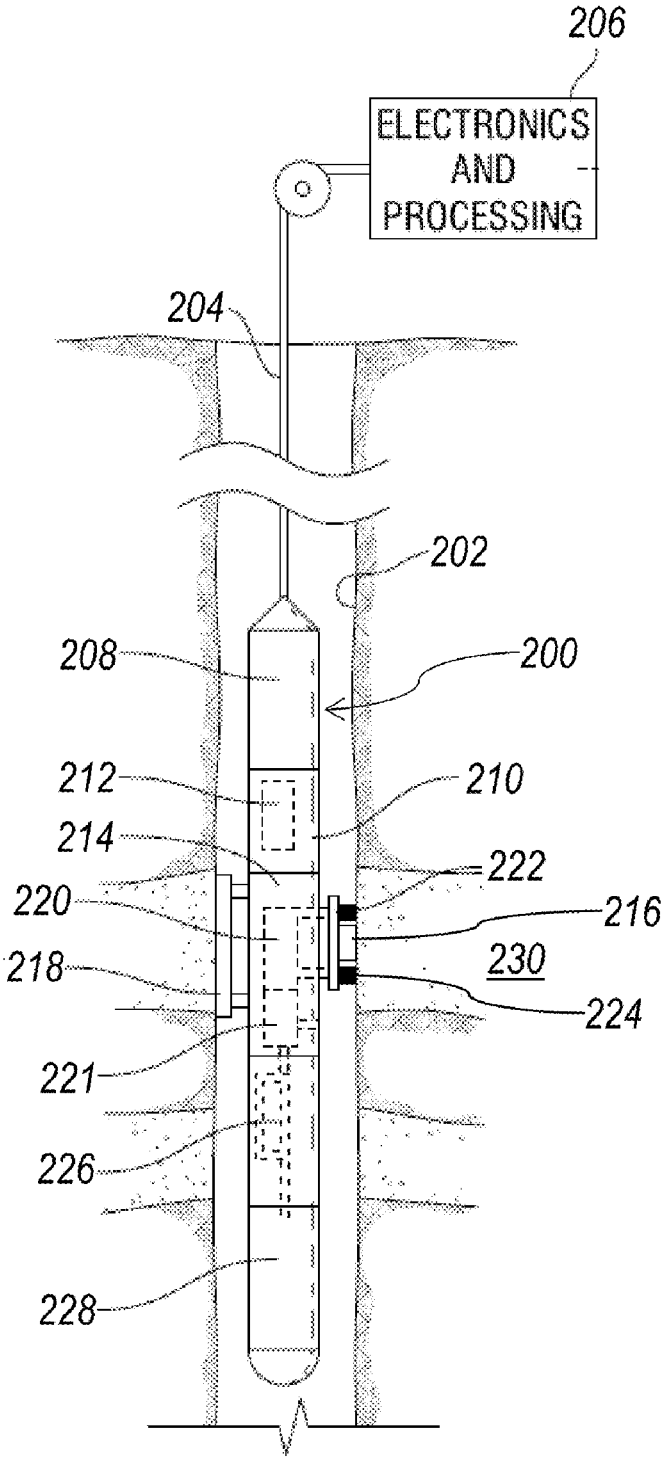
FIG. 2 is a schematic view of a sampling system according to one or more aspects of the present disclosure.

Turning to FIG. 2, an example well site system according to one or more aspects of the present disclosure is shown. The well site may be situated onshore (as shown) or offshore. A wireline tool 200 may be configured to alter a temperature of a portion of the subterranean formation 230 into which a wellbore 202 has been drilled, and extract fluid samples from the portion of the subterranean formation 230. The wireline tool 200 may further be configured to determine a formation fluid temperature and a temperature range of a multiphase region of the formation fluid.

The example wireline tool 200 may be suspended in the wellbore 202 from a lower end of a multi-conductor cable 204 that may be spooled on a winch (not shown) at the Earth's surface. At the surface, the cable 204 may be communicatively coupled to an electronics and processing system 206. The electronics and processing system 206 may include a controller having an interface configured to receive commands from a surface operator. In some cases, the electronics and processing system 206 may further include a processor configured to implement one or more aspects of the methods described herein. The example wireline tool 200 includes an elongated body 208 that may include a telemetry module 210, and a formation tester 214. Although the telemetry module 210 is shown as being implemented separate from the formation tester 214, the telemetry module 210 may be implemented in the formation tester 214. Further, additional components may also be included in the tool 200.

The formation tester 214 may comprise a selectively extendable fluid admitting assembly 216 and a selectively extendable tool anchoring member 218 that are respectively arranged on opposite sides of the body 208. As shown, the fluid admitting assembly 216 is configured to selectively seal off or isolate selected portions of the wall of the wellbore 202, and to fluidly couple components of the formation tester 214, for example, a pump 221, to the adjacent formation 230. Thus, the formation tester 214 may be used to obtain fluid samples from the formation 230. A fluid sample may thereafter be expelled through a port (not shown) into the wellbore or the sample may be sent to one or more fluid collecting chambers disposed in a sample carrier module 228. In turn, the fluid collecting chambers may receive and retain the formation fluid for subsequent testing at the surface or a testing facility. The fluid collecting chambers may comprise bottles known as single-phase sample bottles. For example, the single-phase sample bottles may include a piston and a hydraulic fluid in pressure communication with a face of the piston. The hydraulic fluid may include a gas buffer (e.g., compressed nitrogen) configured to expand and maintain the fluid sample pressure as the fluid sample is brought to the surface. Thus, the fluid sample retained in the fluid collecting chamber may be kept in single phase.

The fluid admitting assembly 216 of the formation tester 214 may be provided with a plurality of thermal sources 222 and 224 disposed adjacent to an inlet of the fluid admitting assembly 216, and configured to alter a temperature of a portion of the formation 230 proximate the fluid admitting assembly 216. For example, the thermal sources 222 and 224 may be configured to radiate microwaves in the portion of the subterranean formation to heat water or other connate or injected downhole fluids in the portion of the subterranean formation. This configuration may be advantageous in wellbores containing oil based mud, for example, because oil based mud filtrate may be essentially transparent to microwaves radiated in a frequency range corresponding to a fraction of the molecular rotational absorption of water (for example, a frequency of 2.45 GHz). Alternatively, or additionally, the thermal sources 222 and 224 may comprise a heated pad configured to convect heat into the portion of the subterranean formation. This configuration may be advantageous in wellbores containing water based mud. The thermal sources 222 and 224 may further comprise a cooling pad or a heat pipe inserted in a hole (not shown) drilled into the subterranean formation and thermally coupled to a heat pump configured to decrease the temperature of the portion of the formation 230 proximate the fluid admitting assembly 216. For example, the heat pump may comprise a thermo-acoustic system, such as described in U.S. Patent Application Pub. No. 2008/0223579, incorporated herein by reference. Other examples implementations of the thermal sources 222 and 224 may be found in U.S. Patent Application Pub. Nos. 2008/0078581 and 2009/0008079, and PCT Patent Application Pub. Nos. 2007/048991 and 2008/150825, the disclosures of which are incorporated herein by reference. It should be appreciated, however, that one or more of the thermal sources 222 and 224 may include any combination of conventional and/or future-developed thermal sources within the scope of the present disclosure.

The formation tester 214 may be provided with a fluid sensing unit 220 through which the obtained fluid samples may flow and which is configured to measure properties and/or composition data of the fluid extracted from the formation 230. For example, the fluid sensing unit 220 may include a fluorescence sensor, such as described in U.S. Pat. Nos. 7,002,142 and 7,075,063, incorporated herein by reference. The fluid sensing unit 220 may alternatively or additionally include an optical fluid analyzer, for example as described in U.S. Pat. No. 7,379,180, incorporated herein by reference. The fluid sensing unit 220 may alternatively or additionally comprise a density and/or viscosity sensor, for example as described in U.S. Patent Application Pub. No. 2008/0257036, incorporated herein by reference. The fluid sensing unit 220 may alternatively or additionally include a high resolution pressure and/or temperature gauge, for example as described in U.S. Pat. Nos. 4,547,691 and 5,394,345, incorporated herein by reference. An implementation example of sensors in the fluid sensing unit 220 may be found in "*New Downhole-Fluid Analysis-Tool for Improved Formation Characterization*" by C. Dong, et al., SPE 108566, December 2008, incorporated herein by reference. It should be appreciated, however, that the fluid sensing unit 220 may include any combination of conventional and/or future-developed sensors within the scope of the present disclosure.

The formation tester 214 may also be provided with a fluid isolation and analysis tool 226 fluidly coupled to the fluid admitting assembly 216 and the pump 221 and configured to lower a pressure of a sealed fluid sample below a phase transition pressure and determine a value of the phase transition pressure. One implementation of the fluid isolation and analysis tool 226 may be found in U.S. Patent Application Pub. No. 2009/0078412, incorporated herein by reference. The fluid isolation and analysis tool 226 may include a four-port, two-position valve (not shown) configured to selectively flow the fluid extracted from the formation 230 through a test volume, or seal a portion of the fluid extracted from the formation 230 in the test volume. The fluid isolation and analysis tool 226 may also include a pressure/volume changing device (not shown) configured to controllably induce or affect a pressure and/or volume change of the fluid sample sealed in the test volume. The fluid isolation and analysis tool 226 may also include a pressure sensor (not shown) configured to measure the pressure of the sealed sample, and a light scattering sensor (not shown) configured to detect the phase transition of the sealed fluid sample. It should be appreciated however that the fluid isolation and analysis tool 226 may include any combination of conventional and/or future-developed sensors within the scope of the present disclosure, such as, for example, a microwave resonator as described in U.S. Pat. No. 6,879,166, incorporated herein by reference.

The telemetry module 210 may comprise a downhole control system 212 communicatively coupled to the electrical control and data acquisition system 206. The electrical control and data acquisition system 206 and/or the downhole control system 212 may be configured to control the fluid admitting assembly 216 and/or the extraction of fluid samples from the formation 230, for example the pumping rate of pump 221. The electrical control and data acquisition system 206 and/or the downhole control system 212 may further be configured to drive the thermal sources 222 and 224, for example, to activate the thermal sources 222 and 224 for a predetermined duration and/or to control the temperature change of the portion of the subterranean formation induced by the thermal sources 222 and 224.

The electrical control and data acquisition system 206 and/or the downhole control system 212 may still further be configured to analyze and/or process data obtained, for example, from downhole sensors (not shown) disposed in the fluid sensing unit 220 or from other downhole sensors (not shown) disposed in the fluid isolation and analysis tool 226, store measurements or processed data, and/or communicate measurements or processed data to the surface or another component for subsequent analysis. For example, a formation fluid temperature and/or a temperature range of a multiphase region of the formation fluid may be determined from data obtained from downhole sensors disposed in fluid sensing unit 220 and/or from other downhole sensors disposed in the fluid isolation and analysis tool 226. Also, the temperature of the portion of the subterranean formation and/or a power used to alter the temperature of the portion of the subterranean formation may be monitored when the thermal sources 222 and 224 are activated. The monitored temperature and/or power may be used to detect a phase transition in the portion of the subterranean formation.

Figure 3A:
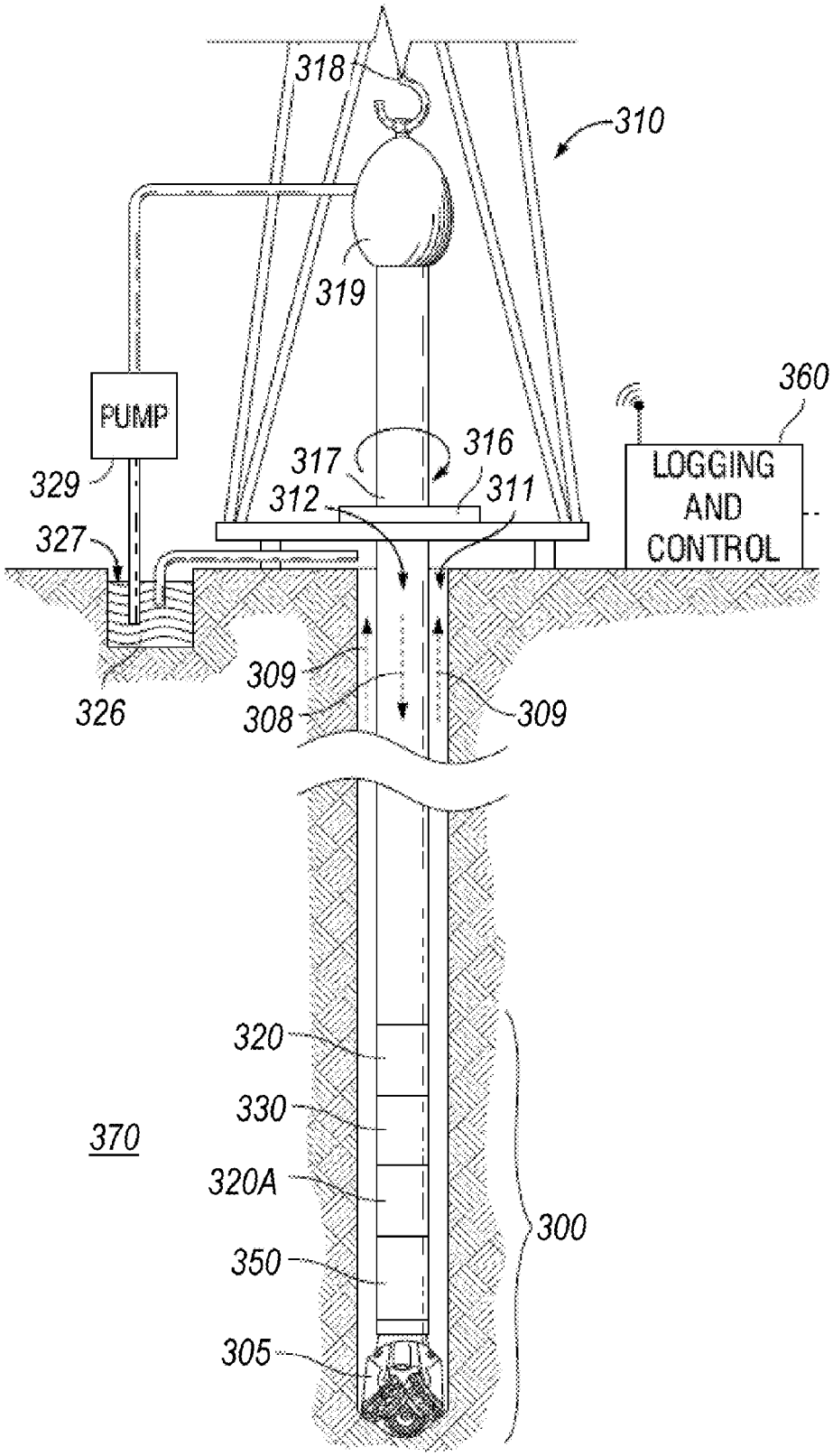
FIG. 3A is a schematic view of another sampling system according to one or more aspects of the present disclosure.
Figure 3B:
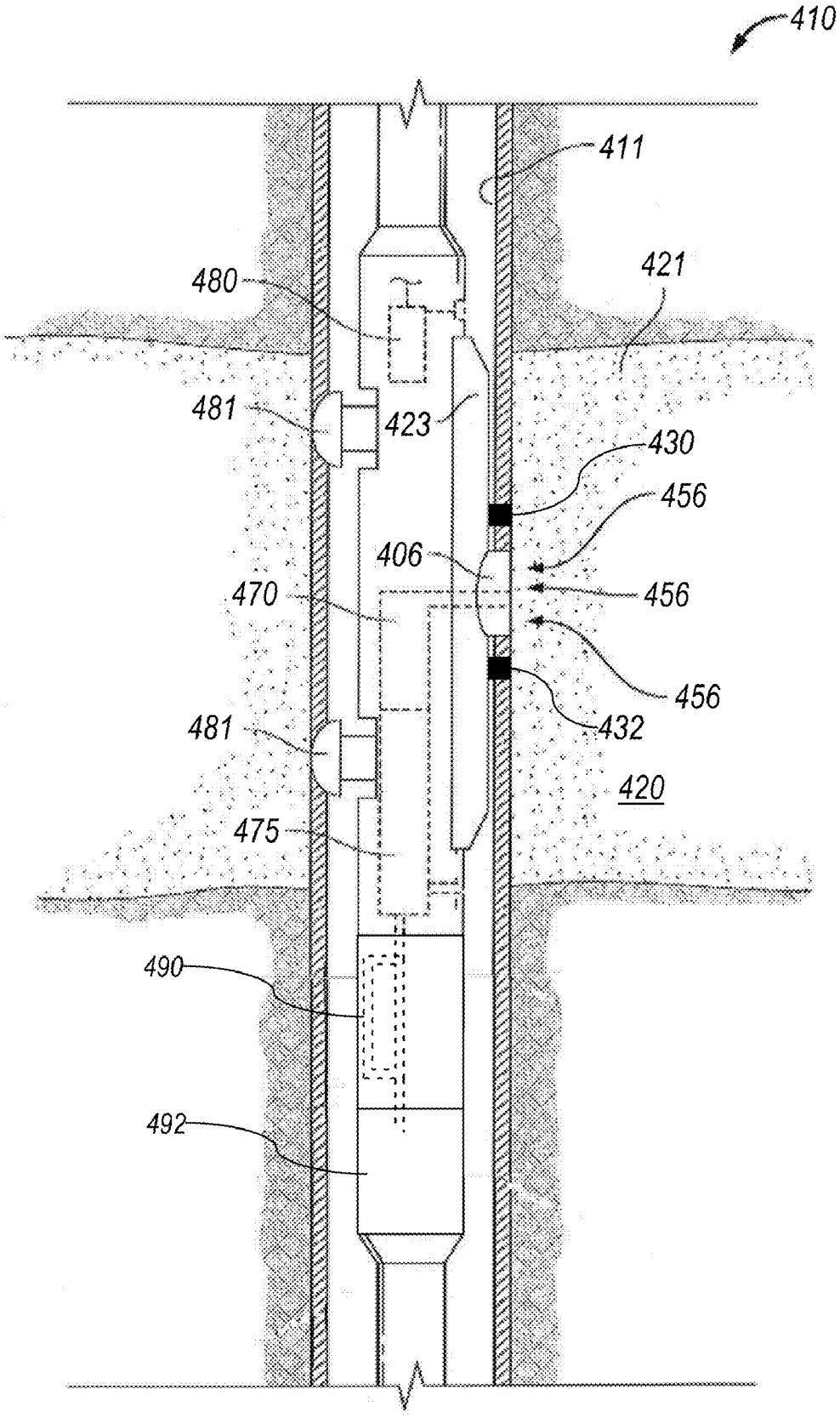
FIG. 3B is a schematic view of a portion of the fluid analysis system shown in FIG. 3A.

Turning to FIGS. 3A and 3B, collectively, an example well site system according to one or more aspects of the present disclosure is shown. The well site may be situated onshore (as shown) or offshore. The system comprises one or more sampling-while drilling device 320, 320A, 410 that may be configured to alter a temperature of a portion of the subterranean formation 370, 420 into which a wellbore 311, 411 has been drilled, and extract fluid samples from the portion of the subterranean formation 370, 420. The sampling-while drilling device 320, 320A, and/or 410 may further be configured to determine a formation fluid temperature and a temperature range of a multiphase region of the formation fluid.

Referring to FIG. 3A, the wellbore 311 may be drilled through subsurface formations by rotary drilling in a manner that is well known in the art. However, the present disclosure also contemplates others examples used in connection with directional drilling apparatus and methods.

A drill string 312 may be suspended within the wellbore 311 and may include a bottom hole assembly (BHA) 300 proximate the lower end thereof. The BHA 300 may include a drill bit 305 at its lower end. It should be noted that in some implementations, the drill bit 305 may be omitted and the bottom hole assembly 300 may be conveyed via tubing or pipe. The surface portion of the well site system may include a platform and derrick assembly 310 positioned over the wellbore 311, the assembly 310 including a rotary table 316, kelly 317, hook 318 and rotary swivel 319. The drill string 312 may be rotated by the rotary table 316, which is itself operated by well known means not shown in the drawing. The rotary table 316 engages the kelly 317 at the upper end of the drill string 312. As is well known, a top drive system (not shown) could alternatively be used instead of the kelly 317 and rotary table 316 to rotate the drill string 312 from the surface. The drill string 312 may be suspended from the hook 318. The hook 318 may be attached to a traveling block (not shown) through the kelly 317 and the rotary swivel 319, which permits rotation of the drill string 312 relative to the hook 318.

In the example of FIG. 3A, the surface system may include drilling fluid (or mud) 326 stored in a tank or pit 327 formed at the well site. A pump 329 may deliver the drilling fluid 326 to the interior of the drill string 312 via a port in the swivel 319, causing the drilling fluid 326 to flow downwardly through the drill string 312 as indicated by the directional arrow 308. The drilling fluid 326 may exit the drill string 312 via water courses, nozzles, or jets in the drill bit 305, and then may circulate upwardly through the annulus region between the outside of the drill string and the wall of the wellbore, as indicated by the directional arrows 309. The drilling fluid 326 may lubricate the drill bit 305 and may carry formation cuttings up to the surface, whereupon the drilling fluid 326 may be cleaned and returned to the pit 327 for recirculation. The circulation of the drilling fluid 326 through the annulus region between the outside of the drill string and the wall of the wellbore may be used to alter the temperature of the subterranean formation 370, 420, for example to reduce the temperature of a portion of the subterranean formation 370, 420.

The bottom hole assembly 300 may include a logging-while-drilling (LWD) module 320, a measuring-while-drilling (MWD) module 330, a rotary-steerable directional drilling system and hydraulically operated motor 350, and the drill bit 305.

The LWD module 320 may be housed in a special type of drill collar, as is known in the art, and may contain a plurality of known types of well logging instruments. It will also be understood that more than one LWD module may be employed, for example, as represented at 320A (references, throughout, to a module at the position of LWD module 320 may alternatively mean a module at the position of LWD module 320A as well). The LWD module 320 may include capabilities for measuring, processing, and storing information, as well as for communicating with the MWD 330. In particular, the LWD module 320 may include a processor configured to implement one or more aspects of the methods described herein. In the present example, the LWD module 320 includes a sampling-while-drilling device as will be further explained hereinafter.

The MWD module 330 may also be housed in a special type of drill collar, as is known in the art, and may contain one or more devices for measuring characteristics of the drill string and drill bit. The MWD module 330 may further include an apparatus (not shown) for generating electrical power for the downhole portion of the well site system. Such apparatus typically includes a turbine generator powered by the flow of the drilling fluid 326, it being understood that other power and/or battery systems may be used while remaining within the scope of the present disclosure. In the present example, the MWD module 330 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD module 330 may further comprise an annular pressure sensor, and a natural gamma ray sensor. The MWD module 330 typically includes capabilities for measuring, processing, and storing information, as well as for communicating with a logging and control unit 360. For example, the MWD module 330 and the logging and control unit 360 may communicate information either ways (i.e., uplinks and/or downlinks) via systems sometimes referred to as mud pulse telemetry (MPT), and/or wired drill pipe (WDP) telemetry. In some cases, the logging and control unit 360 may include a controller having an interface configured to receive commands from a surface operator. Thus, commands may be sent to one or more components of the BHA 300, and more specifically to the LWD tool 320.

A sampling-while-drilling device 410 (e.g., similar to the LWD tool 320 in FIG. 3A) is shown in FIG. 3B. The sampling-while-drilling device 410 of FIG. 3B may be of a type described, for example, in U.S. Patent Application Publication No. 2008/0156486, incorporated herein by reference. However, other types of sampling-while-drilling devices may be used to implement the sampling-while-drilling device 410 or portions thereof within the scope of the present disclosure. The sampling-while-drilling device 410 may be provided with a stabilizer that may include one or more blades 423 configured to engage a wall of the wellbore 411. The sampling-while-drilling device 410 may be provided with a plurality of backup pistons 481 configured to assist in applying a force to push and/or move the sampling-while-drilling device 410 against the wall of the wellbore 411. The configuration of the blade 423 and/or the backup pistons 481 may be of a type described, for example, in U.S. Pat. No. 7,114,562, incorporated herein by reference. However, other types of blade or piston configurations may be used to implement the sampling-while-drilling device 410 within the scope of the present disclosure.

A fluid admitting assembly 406 may extend from the stabilizer blade 423 of the sampling-while-drilling device 410. The fluid admitting assembly 406 may be configured to selectively seal off or isolate selected portions of the wall of the wellbore 411 to fluidly couple to an adjacent formation 420. Once the fluid admitting assembly 406 fluidly couples to the adjacent formation 420, various measurements may be conducted on the adjacent formation 420, for example, a pressure parameter may be measured by performing a pretest. Also, a pump 475 may be used to draw subterranean formation fluid 421 from the formation 420 into the sampling-while-drilling device 410 in a direction generally indicated by arrows 456. The fluid may thereafter be expelled through a port (not shown) into the wellbore, or it may be sent to one or more fluid collecting chambers disposed in a sample carrier module 492, which may receive and retain the formation fluid for subsequent testing at another component, the surface or a testing facility. The fluid collecting chambers may comprise bottles known as single-phase sample bottles, as described above.

In the illustrated example, the stabilizer blade 423 of the sampling-while-drilling device 410 is provided with a plurality of thermal sources 430 and 432 disposed adjacent to an inlet of the fluid admitting assembly 406, and configured to alter a temperature of a portion of the formation 420 proximate the fluid admitting assembly 406. For example, the thermal sources 430 and 432 may be of a type described in relation to the thermal sources 222 and 224 of FIG. 2 herein.

The sampling-while-drilling device 410 may include a fluid sensing unit 470 through which the obtained fluid samples may flow, and which may be configured to measure properties of the fluid samples extracted from the formation 420. For example, the fluid sensing unit 470 may be of a type described in relation to the fluid sensing unit 220 of FIG. 2 herein. It should be appreciated that the fluid sensing unit 470 may include any combination of conventional and/or future-developed sensors within the scope of the present disclosure.

The sampling-while-drilling device 410 may be provided with a fluid isolation and analysis tool 490, fluidly coupled to the fluid admitting assembly 406 and the pump 475, and configured to lower a pressure of a sealed fluid sample below a phase transition pressure and determine a value of the phase transition pressure. For example, the fluid isolation and analysis tool 490 may be of a type described in relation to the fluid isolation and analysis tool 226 of FIG. 2 herein. It should be appreciated that other types of fluid isolation and analysis tools may be used to implement the fluid isolation and analysis tool 490 or portions thereof within the scope of the present disclosure.

A downhole control system 480 may be configured to control the operations of the sampling-while-drilling device 410. For example, the downhole control system 480 may be configured to control the extraction of fluid samples from the formation 420, for example, via the pumping rate of the pump 475. The downhole control system 480 may further be configured to drive the thermal sources 430 and 432, for example, to activate the thermal sources 430 and 432 for a predetermined duration and/or to control the temperature change of the portion of the subterranean formation induced by the thermal sources 430 and 432. The downhole control system 480 may still further be configured to analyze and/or process data obtained, for example, from downhole sensors disposed in the fluid sensing unit 470 or from other downhole sensors disposed in the fluid isolation and analysis tool 490, store measurement or processed data, and/or communicate measurement or processed data to another component and/or the surface (e.g., to the logging and control unit 360 of FIG. 3A) for subsequent analysis. For example, a formation fluid temperature and/or a temperature range of a multiphase region of the formation fluid may be determined from data obtained from downhole sensors disposed in the fluid sensing unit 470 and/or from other downhole sensors disposed in the fluid isolation and analysis tool 490. Also, the temperature of the portion of the subterranean formation and/or a power used to alter the temperature of the portion of the subterranean formation may be monitored when the thermal sources 430 and 432 are activated. The monitored temperature and/or power may be used to detect a phase transition in the portion of the subterranean formation. More generally, the logging and control unit 360 (in FIG. 3A) and/or the downhole control system 480 may include a processor configured to implement one or more aspects of the methods described herein.

While the wireline tool 200 (in FIG. 2) and the sampling-while-drilling device 410 (in FIG. 3B) are depicted as having one fluid admitting assembly, a plurality of fluid admitting assemblies may alternatively be provided on the wireline tool 200 and/or the sampling-while-drilling device 410. For example, the fluid admitting assembly of the wireline tool 200 (in FIG. 2) and/or the sampling-while-drilling device 410 (in FIG. 3B) may be implemented with a guarded or focused fluid admitting assembly, such as shown in U.S. Pat. No. 6,964,301, incorporated herein by reference. In these cases, the fluid sensing unit 220 (in FIG. 2), the fluid isolation and analysis tool 226 (in FIG. 2), the fluid sensing unit 470 (in FIG. 3B) and/or the fluid isolation and analysis tool 490 (in FIG. 3B) may be fluidly coupled to a central inlet of the guarded or focused fluid admitting assembly. Further, the wireline tool 200 (in FIG. 2) and the sampling-while-drilling device 410 (in FIG. 3B) may be implemented with inflatable packers to seal off or isolate selected portions of the wellbore wall above and below at least one inlet port. Still further, the wireline tool 200 (in FIG. 2) and the sampling-while-drilling device 410 (in FIG. 3B) may be provided with a drilling shaft protruding from an inlet of the fluid admitting assembly. The drilling shaft may be used to drill a perforation through a casing and/or into the formation.

Figure 4:
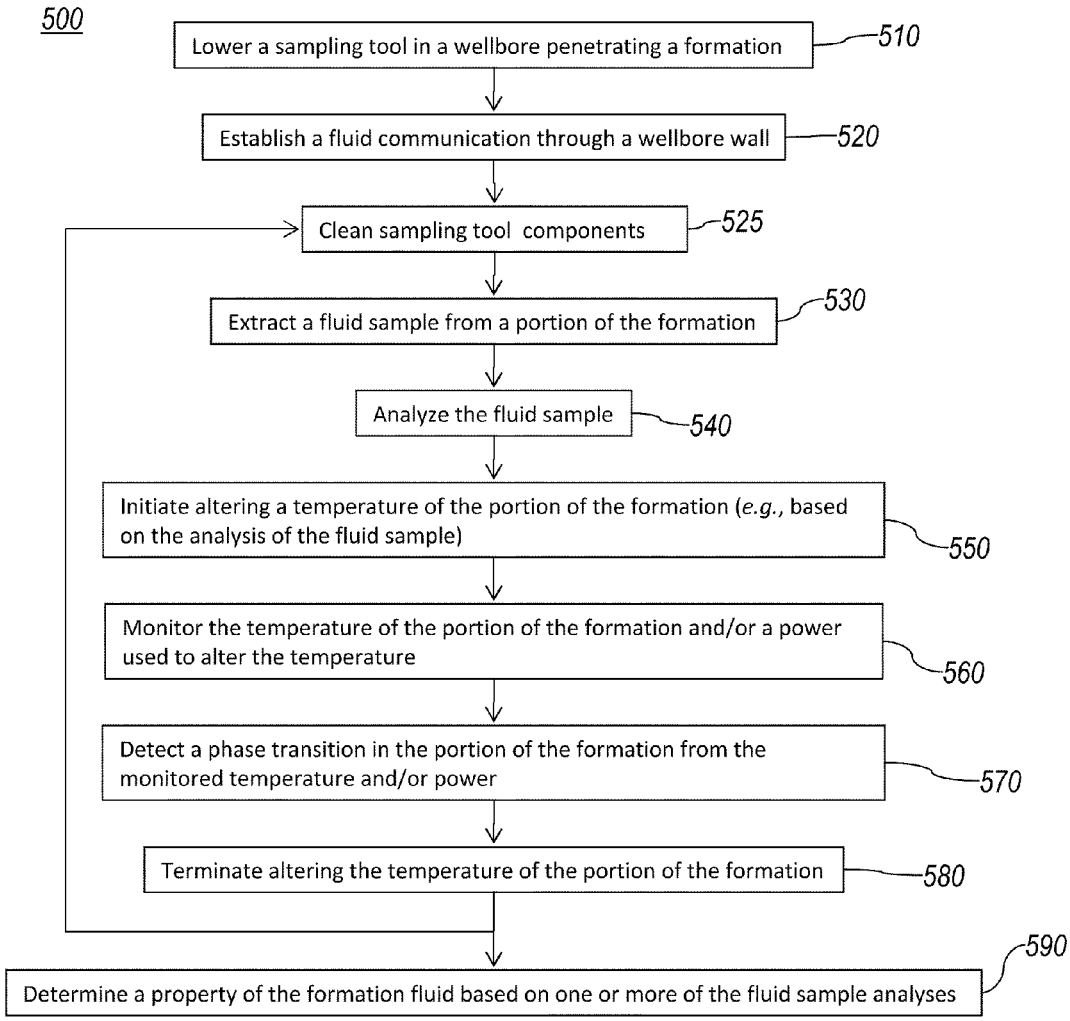
FIG. 4 is a flow chart of at least a portion of a method of sampling and evaluating a subterranean formation fluid according to one or more aspects of the present disclosure.

FIG. 4 is a flow chart of at least a portion of a method 500 of sampling and/or evaluating a subterranean formation fluid according to one or more aspects of the present disclosure. It should be appreciated that the order of execution of the steps depicted in FIG. 4 may be changed and/or some of the steps described may be combined, divided, rearranged, omitted, eliminated and/or implemented in other ways within the scope of the present disclosure. The method 500 may involve increasing or decreasing a temperature of a portion of the formation close to a fluid admitting assembly of a sampling tool. Increasing or decreasing the temperature of the portion of the formation may permit obtaining at least one fluid sample without entering a multi phase region of the subterranean formation fluid. The method 500 may be performed using, for example, the wireline tool 200 (in FIG. 2) and/or the sampling-while-drilling device 410 (in FIG. 3B).

Referring to FIGS. 2, 3B and 4, collectively, at step 510, a sampling tool (e.g., the wireline tool 200 and/or the sampling-while-drilling device 410) may be lowered in a wellbore (e.g., the wellbore 202 and/or the wellbore 411) penetrating a subterranean formation (e.g., the formation 230 and/or the formation 420).

At step 520, fluid communication may be established through a wellbore wall. For example, the sampling tool may comprise a selectively extendable fluid admitting assembly (e.g., the fluid admitting assembly 216 and/or the fluid admitting assembly 406) and a selectively extendable tool anchoring member (e.g., the tool anchoring member 218 and/or the plurality of backup pistons 481) that cooperate to seal off or isolate selected portions of the wall of the wellbore, and to fluidly couple components of the sampling tool (e.g., the pump 221 and/or the pump 475) to the adjacent formation. In some cases, the sampling tool may be provided with a drilling shaft configured to drill a perforation through a casing and/or into the formation. In these cases, the perforation may extend beyond a zone invaded by drilling fluid filtrate in the formation and/or beyond a zone having reduced permeability from damage caused by drilling the well. Thus, the drilling shaft (or other scraping means) may be used to remove at least a portion of one of a mud cake lining the wellbore and a damaged portion of the subterranean formation prior to extracting the fluid sample, thereby mechanically removing contaminated fluids contained in the mud cake pores, improving the fluid communication between the sampling tool and the formation through the damaged zone, and/or facilitating the extraction of pristine subterranean formation fluid. The sampling tool may also be provided with a sampling tube configured to extend in the perforation.

At step 525, sampling tool components may be cleaned. For example, flow lines, sensing surfaces of sensors (e.g., sensors disposed in the fluid sensing unit 220 and/or the fluid sensing unit 470) may be contaminated by fluids and/or solids introduced in the sampling tool during preliminary downhole sampling operations. These contaminants may be removed prior to extracting a new fluid sample, so that the chemical composition of the sample is less affected by the presence of the contaminants. Contaminants may be removed by flushing the sampling tool components, for example with high pressure inert gas such as argon, with water, etc., disposed in a container conveyed by the sampling tool. Examples of apparatus and/or methods that may be used to clean components of the sampling tool may be found in U.S. Patent Application Pub. No. 2008/0093078 or PCT Patent Application Pub. No. 2009/052235, incorporated herein by reference.

At step 530, a fluid sample may be extracted from the formation. For example, a fluid extraction device (e.g., the pump 221 and/or the pump 475) may be used to reduce the pressure within the sampling tool below the formation pressure. The fluid extraction device may be configured to induce an extraction flow rate of at least about 0.1 $cm^3 \cdot s^{-1}$. However, other extraction flow rates are also within the scope of the present disclosure.

As is well known, the sampled fluid may be contaminated with drilling fluid filtrate. The drilling fluid filtrate may penetrate the formation and displace, compress and/or diffuse into the connate formation fluids. In some cases, the drilling fluid may be oil based. Oil based mud (OBM) may predominately contain molecules with between 14 and 20 carbon atoms; for example, some OBM may be derived from diesel. When these molecules diffuse into the formation (such as a gas condensate bearing formation), even small amounts of filtrate may contaminate the sample in such way that the chemical composition or the phase behavior of the contaminated fluid may not be representative of the chemical composition or the phase behavior of the connate formation fluid. Therefore, the fluid extraction at step 530 may be performed for a sufficient duration so that the extracted sample has an adequately low contamination level, such as to obtain a hydrocarbon sample when an OBM has been used for drilling the well. For example, contamination monitoring may be performed using a sensor of a fluid sensing unit (e.g., the fluid sensing unit 220 and/or the fluid sensing unit 470), the sensor depending on the type of sampled fluid. When the sampled fluid is black oil and the OBM is essentially a clear liquid, the contamination monitoring may be achieved by observing a light absorption of the extracted fluid as a function of the pumping time/volume, and measured for example by an optical analyzer in the visible range. When the sampled fluid contains methane and the methane does not significantly diffuse in the OBM filtrate, the contamination monitoring may be achieved by observing a light absorption of the extracted fluid as a function of the pumping time/volume, and measured for example by an optical analyzer in the near infrared range and at a wavelength associated to methane absorption. When the sample fluid is a gas condensate, the contamination monitoring may be achieved by observing one or more fluorescence characteristics of the extracted fluid as a function of the pumping time/volume, and measured for example by a fluorescence sensor in the visible or the soft ultraviolet range. Other examples of contamination monitoring include observing the extracted fluid density, the extracted fluid refractive index, the extracted fluid pH, and the extracted fluid nuclear magnetic resonance (NMR) response, among others.

While performing the fluid extraction at step 530 for a sufficient duration may be an efficient technique to extract a sample having an adequately low contamination level, alternative or additional techniques may be used within the scope of the present disclosure. For example, contamination may be significantly reduced by using a guarded or focused fluid admitting assembly having a central sample inlet connected to a first flow line and configured to pump pristine fluid, and a peripheral cleanup inlet connected to a second flow line and configured to pump contaminated fluid. Extracting a fluid sample from the subterranean formation may comprise pumping the fluid sample through the central inlet of the sampling tool while pumping mud filtrate through the peripheral inlet of the sampling tool. Also, a drilling shaft or other scraping means may be used to remove at least a portion of a mud cake lining the wellbore and/or a damaged portion of the subterranean formation prior to extracting the fluid sample, thereby mechanically removing contaminated fluids contained in the mud cake pores, improving the fluid communication between the sampling tool and the formation through the damaged zone, and/or facilitating the extraction of pristine subterranean formation fluid. However, some mud cake may be left against the wellbore wall to act as a thermal conduction path during heating or cooling the formation adjacent to the sampling apparatus.

At step 540, the fluid sample extracted at step 530 may be analyzed in situ. The fluid sample may be analyzed to detect whether it is in single phase. For example, the analysis at step 540 may be performed using the fluid sensing unit (e.g., the fluid sensing unit 220 and/or the fluid sensing unit 470). The analysis performed at step 540 may indicate that the fluid sample contains gas bubbles within a liquid phase, a dew mist or a dew film in a gas phase, and/or asphaltene aggregates and/or wax crystals in a liquid phase. In other cases, the fluid sensing unit may be used to detect slugs of gas and liquid as the fluid is extracted from the formation, and/or as the fluid extracted from the formation segregates in a flow line of the downhole tool. The analysis at step 540 may alternatively or additionally be performed using a fluid isolation and analysis tool (e.g., the fluid isolation and analysis tool 226 and/or the fluid isolation and analysis tool 490). In cases where the sampled fluid is not in single phase, the isolated portion of the sampled fluid may be critical (i.e., in conditions close to a phase transition). For example, a pressure of an isolated portion of the fluid sample may be lowered. An amount of a discrete phase generated by lowering the pressure may be determined as a function of the pressure of the isolated portion of the fluid sample. The determined amount of discrete phase may change significantly, even for pressure levels marginally lower than the sampling pressure. Conversely, the isolated portion of the fluid sample may be increased. An amount of a discrete phase recombined by increasing the pressure may be determined as a function of the pressure of the isolated portion of the fluid sample. The determined amount of discrete phase may change significantly, even for pressure levels marginally higher than the sampling pressure.

While the analysis preformed at step 540 may be tailored to indicating whether the sample extracted at step 530 is single phase or not, other fluid evaluations may be performed at step 540, such as measuring composition data of the sample (such as concentration of methane C1, of ethane C2, of the lumped group of propane, butane, and pentane, C3-5, of the lumped group of hydrocarbons molecules having six carbons or more C6+, of carbon dioxide CO2, of water H2O, gas oil ratio GOR, etc.), and/or measuring thermophysical properties (such as fluid sample density and/or viscosity, compressibility, phase transition pressure, etc.). Also, the analysis in situ of the fluid sample at step 540 may be omitted in some cases, and may be performed at surface. In these cases, the fluid sample may be retained in a single phase bottle.

At step 550, altering a temperature of the portion of the formation may be initiated. Altering the temperature of the portion of the formation may include increasing the temperature (heating) or decreasing the temperature (cooling) of the portion of the formation for any duration. For example, either heating or cooling may be performed using a thermal source (e.g., the thermal source 222, 224, 430, and/or 432), or using circulation of drilling fluid in the wellbore (as indicated by directional arrows 308 and/or 309 in FIG. 3A), the drilling fluid having a temperature different from the formation temperature. In some cases, the temperature variation of the portion of the subterranean formation resulting from step 550 may move the subterranean formation fluid conditions farther from a multi phase region envelope in a phase diagram section. In these cases, the temperature variation of the portion of the formation may result in a pressure reduction pathway that may be experienced during a sampling process not entering the multi phase region and, thus, may allow extracting a single phase sample. Further, the temperature variation of the portion of the formation may permit greater pressure differences to be applied by the sampling tool without entering the multi phase region. Thus, the temperature variation of the portion of the formation may be used to expedite the extraction of fluid sample from the portion of the formation having altered temperature.

In some cases, the thermal properties of the formation may be used to determine a heating or cooling time suitable for reaching a given temperature profile over a specified volume of the portion of the subterranean formation. While thermal properties of formations may depend on the mineralogy, porosity and the type of fluid filling the formation pores, the variations in thermal diffusivity $\kappa$ between formations are generally small ($\kappa=\lambda/\rho\cdot c_p$, where $\lambda$ is the thermal conductivity of the formation, $\rho$ is the density of the formation, and $c_p$ the isobaric heat capacity of the formation). With prior knowledge of the thermal diffusivity $\kappa$ of the formation, the temperature distribution may be estimated as a function of distance from the wellbore wall, heating or cooling duration, heating or cooling temperature, etc. The temperature distribution estimation may be used to determine a suitable heating or cooling duration, among other things. Further, the total energy used and average power may be estimated. For example, in the case of heating a formation for 24 hours to a temperature of 100° C. above the initial formation temperature, the total energy consumed may be approximately 48 MJ and the average power may be approximately 0.56 kW.

At step 560, the temperature of the portion of the formation and/or a power used to alter the temperature of the portion of the formation may be monitored. For example, when using a temperature controlled thermal source, the power used to alter the temperature of the formation may be monitored. Conversely, when using a power controlled thermal source, the resulting temperature of the formation may be monitored.

At step 570, the temperature and/or power monitored at step 570 may be used to detect a phase transition in the portion of the formation. For example, when using a temperature controlled thermal source, and in the absence of phase transition, the power used to alter the temperature of the formation is expected to gradually decrease as a function of time. An increase of the power used to alter the temperature of the formation may be indicative of a phase transition in the formation. If a phase transition in the formation is suspected, the step of altering the temperature of the formation (i.e., the step 550) may be aborted at step 580. Alternatively, the step of altering the temperature of the formation may be modified. For example, the formation may be cooled instead of heated, and vice versa.

At step 580, altering the temperature of the portion of the formation may be terminated. However, altering the temperature of the portion of the formation may alternatively be continued during a sample extraction operation. For example, altering the temperature of the portion of the formation may be terminated after a predetermined duration. When using a temperature controlled thermal source, altering the temperature of the portion of the formation may be terminated when the monitored power has stabilized, indicating that the wellbore wall has reached a desired temperature.

The operations described in relation to one or more of the steps 525, 530, 540, 550, 560, 570 and 580 may be repeated any number of times. Thus, a plurality of fluid samples of a subterranean formation fluid may be obtained at each of a plurality of temperatures of the portion of the formation associated with the heating or cooling operation described in steps 550, 580. Each of the plurality of fluid samples may be analyzed in situ as described in step 540, and/or each of the plurality of fluid samples may be retained in a separate fluid collecting chamber and brought to the surface. At surface, at least a portion of each of the plurality of fluid samples may be analyzed, for example, in a manner similar to the description of step 540.

At step 590, a property of the formation fluid may be determined by comparing at least two of the plurality of fluid samples. For example, fluid analysis results such as described in step 540 may be compared to determine at which of the plurality of formation temperatures a corresponding one of the plurality of fluid samples is in single phase. The single phase samples may be further analyzed to determine composition data and/or fluid property values thereof, in situ (for example, using the fluid sensing unit 220 and/or 470, and/or the isolation and analysis tool 226, and/or 290), at the Earth's surface, or both. The determined composition data and/or fluid property values may be representative of corresponding composition data and/or fluid property values of the subterranean formation fluid in its pristine state in the formation.

Figure 5:
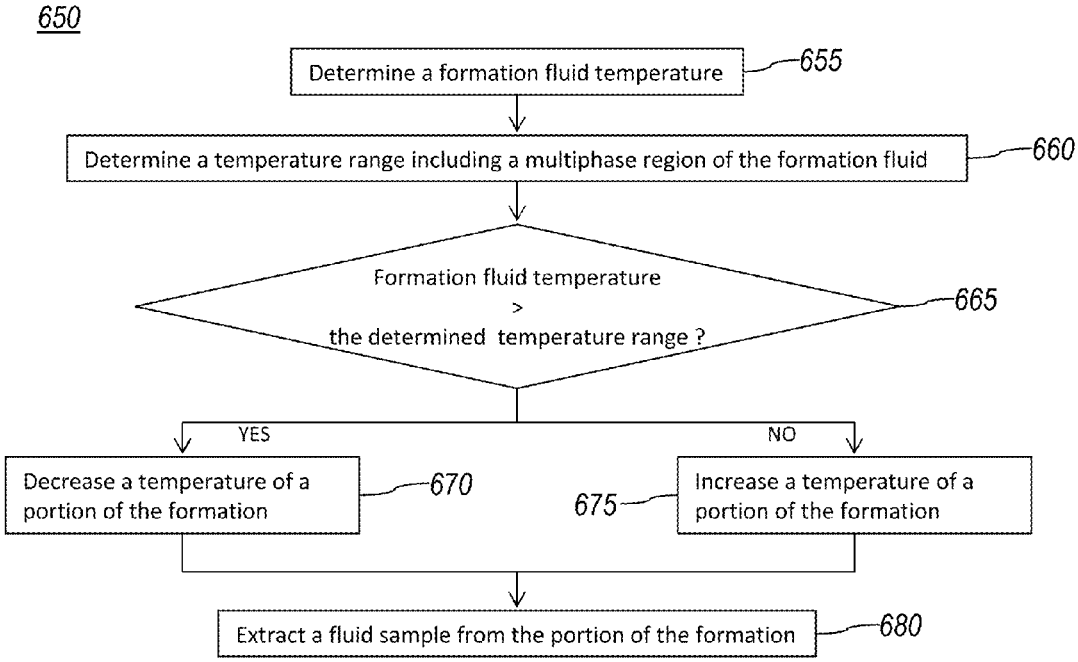
FIG. 5 is a flow chart of at least a portion of a method of altering a temperature of a portion of a subterranean formation and extracting a sample therefrom according to one or more aspects of the present disclosure.

FIG. 5 is a flow chart of at least a portion of a method 650 of sampling and/or evaluating a subterranean formation fluid according to one or more aspects of the present disclosure. It should be appreciated that the order of execution of the steps depicted in the flow chart of FIG. 5 may be changed and/or some of the steps described may be combined, divided, rearranged, omitted, eliminated and/or implemented in other ways within the scope of the present disclosure. The method 650 may involve determining a formation fluid temperature and determining a temperature range of a multi-phase region of the formation fluid to select one of increasing or decreasing a temperature of the portion of the formation close to the fluid admitting assembly of the sampling tool. The method 650 or a portion thereof may be used to alter a temperature of a portion of a formation based on an analysis of a fluid sample, and for example to implement the step 550 of the method 500 (in FIG. 4). The method 650 may be performed using, for example, the wireline tool 200 (in FIG. 2) and/or the sampling-while-drilling device 410 (in FIG. 3B).

At step 655, a formation fluid temperature may be determined, usually before altering the temperature of the subterranean formation. For example, a formation fluid sample may be extracted from the formation and its temperature may be measured by a temperature sensor disposed in a fluid sensing unit (e.g., the fluid sensing unit 220 and/or the fluid sensing unit 470). Alternatively, or additionally, the formation fluid temperature may be inferred at least in part from the wellbore fluid temperature. Descriptions of methods to determine formation temperature may be found in U.S. Pat. Nos. 6,789,937 and 6,905,241, the disclosures of which are incorporated herein by reference.

At step 660, a temperature range including a multiphase region of the subterranean formation fluid may be determined. For example, the temperature range may be determined by estimating at least a portion of a multiphase region envelope of the subterranean formation fluid. More specifically, the portion of the multiphase region envelope may include a temperature value at which the envelope reaches the cricondenbar of the subterranean formation fluid. In some cases, the temperature range including the multiphase region of the subterranean formation fluid may be determined by analogy with fluids from the same field or reservoir. In other cases, the temperature range including the multi-phase region of the subterranean formation fluid may be determined from in situ measurements on a previously acquired fluid sample, for example as described below in relation to the description of FIG. 7.

Figure 6A:
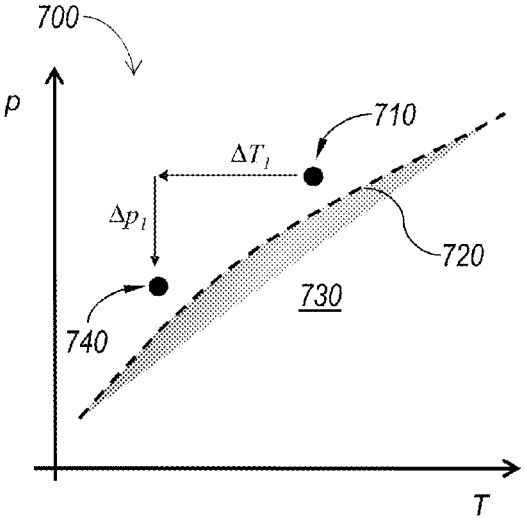
FIGS. 6A and 6B are example graphs illustrating one or more aspects of the method of FIG. 5.
Figure 6B:
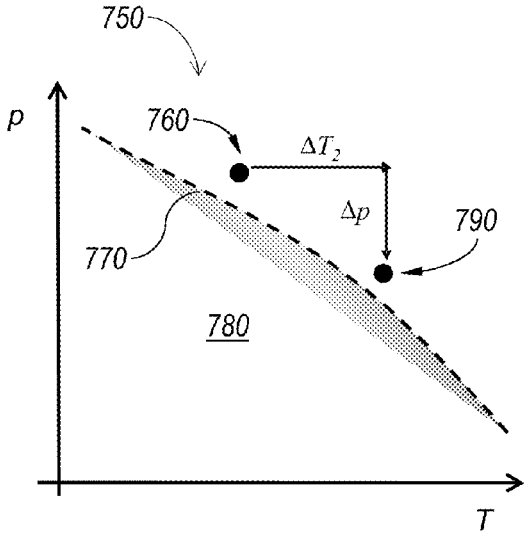

Referring collectively to FIG. 5 and to example pressure temperature sections 700 and 750 of phase diagrams shown in FIGS. 6A and 6B, the formation fluid temperature determined at step 655 and the temperature range determined at step 660 may be compared. For example, the relative position of the subterranean formation fluid pressure/temperature (e.g., the pressure/temperature of data points 710 and/or 760) and the multiphase region envelope in the phase diagram of the subterranean formation fluid (e.g., envelopes 720 and 770 of multiphase regions 730 and 780, respectively) may be determined. More specifically, the subterranean formation fluid temperature may be compared to the temperature value at which the multiphase envelope reaches the cricondenbar of the subterranean formation fluid.

In cases where the formation fluid temperature is lower than the temperature range (e.g., as illustrated in FIG. 6A), the temperature of the portion of the formation may be decreased at step 670, for example by a temperature decrement $\Delta T_1$. In cases where the formation fluid temperature is higher than the temperature range (e.g., as illustrated in FIG. 6B), the temperature of the portion of the formation may be increased at step 675, for example by a temperature increment $\Delta T_2$. For example, the temperature of the portion of the subterranean formation may be increased to a temperature higher than a cricondentherm of the formation fluid. As apparent in FIGS. 6A and 6B, the multiphase region envelope in the phase diagram of the subterranean formation fluid (e.g., the envelope 720 and 770) may not limit the temperature decrement $\Delta T_1$ and/or the temperature increment $\Delta T_2$, that is, the temperature variation may not cause the formation fluid condition to enter its multiphase region (e.g., the multiphase regions 730 and 780). Thus, the formation fluid may be maintained in single phase during the heating and/or cooling of the subterranean formation. It should be appreciated, however, that other considerations may limit the temperature variation, such as thermal cracking of hydrocarbons molecules.

At step 680, a fluid sample may be extracted from the portion of the formation having decreased or increased temperature. As apparent in FIGS. 6A and/or 6B, the step of altering the temperature of the formation close to the wellbore performed at steps 670 and/or 674 may move the subterranean formation fluid conditions farther from the multi phase region envelopes 720 and/or 770. At the altered temperature, the difference between the pressure of the formation fluid and the corresponding pressure on the multi phase region envelope may have significantly increased. Thus, the pressure reduction pathways that may be experienced during a sampling process indicated by $\Delta p_1$ and $\Delta p_2$ respectively in FIGS. 6A and 6B may not enter the multi phase region and, thus, may allow extracting a single phase of the formation fluid.

Figure 7:
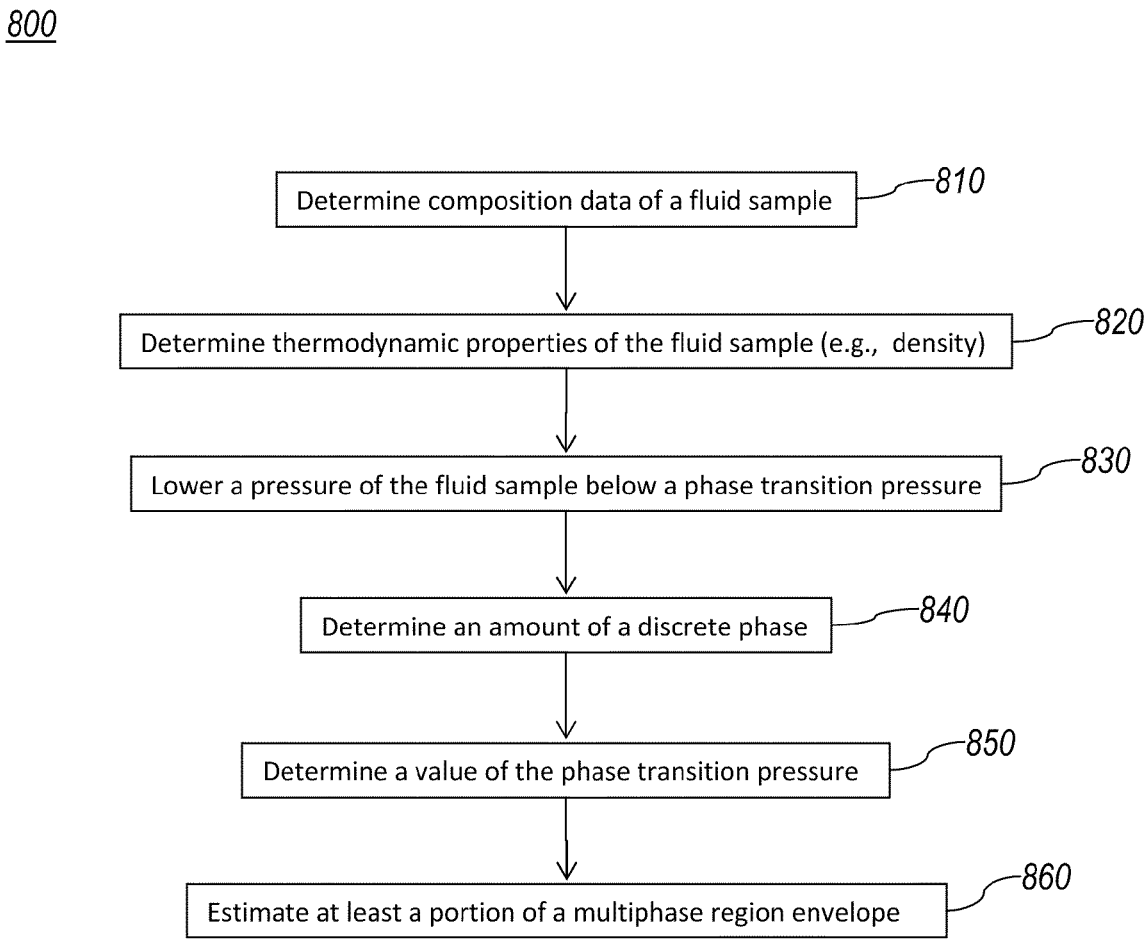
FIG. 7 is a flow chart of at least a portion of a method of determining at least a portion of a multiphase region envelope in a phase diagram of a subterranean formation fluid according to one or more aspects of the present disclosure.

FIG. 7 is a flow chart of at least a portion of a method 800 of determining in situ at least a portion of a multiphase region envelope in a phase diagram of a subterranean formation fluid according to one or more aspects of the present disclosure. It should be appreciated that the order of execution of the steps depicted in the flow chart of FIG. 7 may be changed and/or some of the steps described may be combined, divided, rearranged, omitted, eliminated and/or implemented in other ways within the scope of the present disclosure. The method 800 or a portion thereof may be used to determine a temperature range of a multiphase region of the formation fluid, and for example to implement the step 660 of the method 600 (in FIG. 5). The method 800 may be performed using, for example, a downhole fluid sensing unit (e.g., the fluid sensing unit 220 and/or the fluid sensing unit 470) and/or a fluid isolation and analysis tool (e.g., the fluid isolation and analysis tool 226 and/or the fluid isolation and analysis tool 490).

At step 810, composition data of a fluid sample extracted from a subterranean formation into a sampling tool lowered in a wellbore may be determined in situ. For example, concentrations of one or more of methane C1, of ethane C2, of the lumped group of propane, butane, and pentane, C3-5, of the lumped group of hydrocarbons molecules having six carbons or more C6+, of carbon dioxide CO2, of water H2O, gas oil ration GOR, etc.) may be determined using sensor data collected by the fluid sensing unit 220 and/or the fluid sensing unit 470.

At step 820, thermophysical properties of the fluid sample may be determined. For example, sample density and/or compressibility may be determined using sensor data collected by the fluid sensing unit 220 and/or 470.

At step 830, a pressure of the fluid sample may be lowered below a phase transition pressure. For example, the fluid sample may be isolated in a test volume of the fluid isolation and analysis tool 226 and/or 490. A pressure/volume changing device disposed in the fluid isolation and analysis tool may be used to controllably induce or affect a pressure and/or volume change of the fluid sample sealed in the test volume.

At step 840, an amount of a discrete phase (or continuous phase) may be determined. For example, an amount (e.g., a volume, a quantity) of liquid phase (in this case the discrete phase) formed during or after lowering the pressure at step 830 of a retrograde condensate gas may be estimated by determining whether a mist or a film of liquid has been formed, as described in U.S. Pat. No. 7,002,142. However, other methods of determining an amount of discrete phase may be used within the scope of this disclosure.

At step 850, a value of a phase transition pressure may be determined. For example, a retrograde dew point may be identified. A retrograde dew point may indicate that a liquid phase evaporates when the pressure of the fluid sample is lowered.

At step 860, at least a portion of a multiphase region envelope of the subterranean formation fluid may be estimated. For example, one or more of composition data of the fluid sample determined at step 810, thermodynamic properties of the fluid sample determined at step 820, and the value of the phase transition pressure determined at step 850 may be used to determine at least a portion of a multiphase region envelope of the fluid sample, using methods such as described in U.S. Patent Application Pub. No. 2007/0119244, incorporated herein by reference. The at least portion of the multiphase region envelope of the fluid sample may in turn be employed to estimate the multiphase region envelope of the subterranean formation fluid.

Further, as apparent in FIGS. 1A and 1B, the quality lines (i.e., the lines indicating a constant mole fraction of gas in the multiphase region) are relatively sparser at high temperatures (e.g., at temperatures higher than the temperature at which the envelope of the multiphase region reaches the cricondenbar) than at low temperatures (e.g., at temperatures lower than the temperature at which the envelope of the multiphase region reaches the cricondenbar). The amount of discrete phase formed during or after lowering the pressure at step 830 may be higher when the multiphase region of the fluid sample (and/or of the subterranean formation fluid) is substantially located at temperatures higher than the fluid sample temperature (as illustrated in FIG. 1A), than when the multiphase region (and/or of the subterranean formation fluid) is substantially located at temperatures lower than the fluid sample temperature (as illustrated in FIG. 1A). Thus, at step 860, the amount of discrete phase determined at step 840 may be used to estimate the location in a pressure temperature section of a phase diagram of the multiphase region envelope of the fluid sample (and/or of the subterranean formation fluid) relative to the fluid sample temperature. For example, the location of the temperature at which the envelope of the multiphase region of the fluid sample (and/or of the subterranean formation fluid) reaches the cricondenbar may be estimated relative to the fluid sample temperature.

Still further, the value of the phase transition pressure determined at step 850 may be used to estimate the at least portion of multiphase region envelope at step 860. For example, a retrograde dew point may be used to determine that the sample fluid is a retrograde gas condensate. A retrograde gas condensate may be characterized by a temperature between the critical temperature and the cricondentherm. Thus, the retrograde dew point detection may be indicative of the temperature range of a multiphase region of the retrograde gas condensate. According to the method 650 of FIG. 5, heating the retrograde gas condensate, for example above the cricondentherm, may facilitate extracting a single phase sample.

Figure 8:
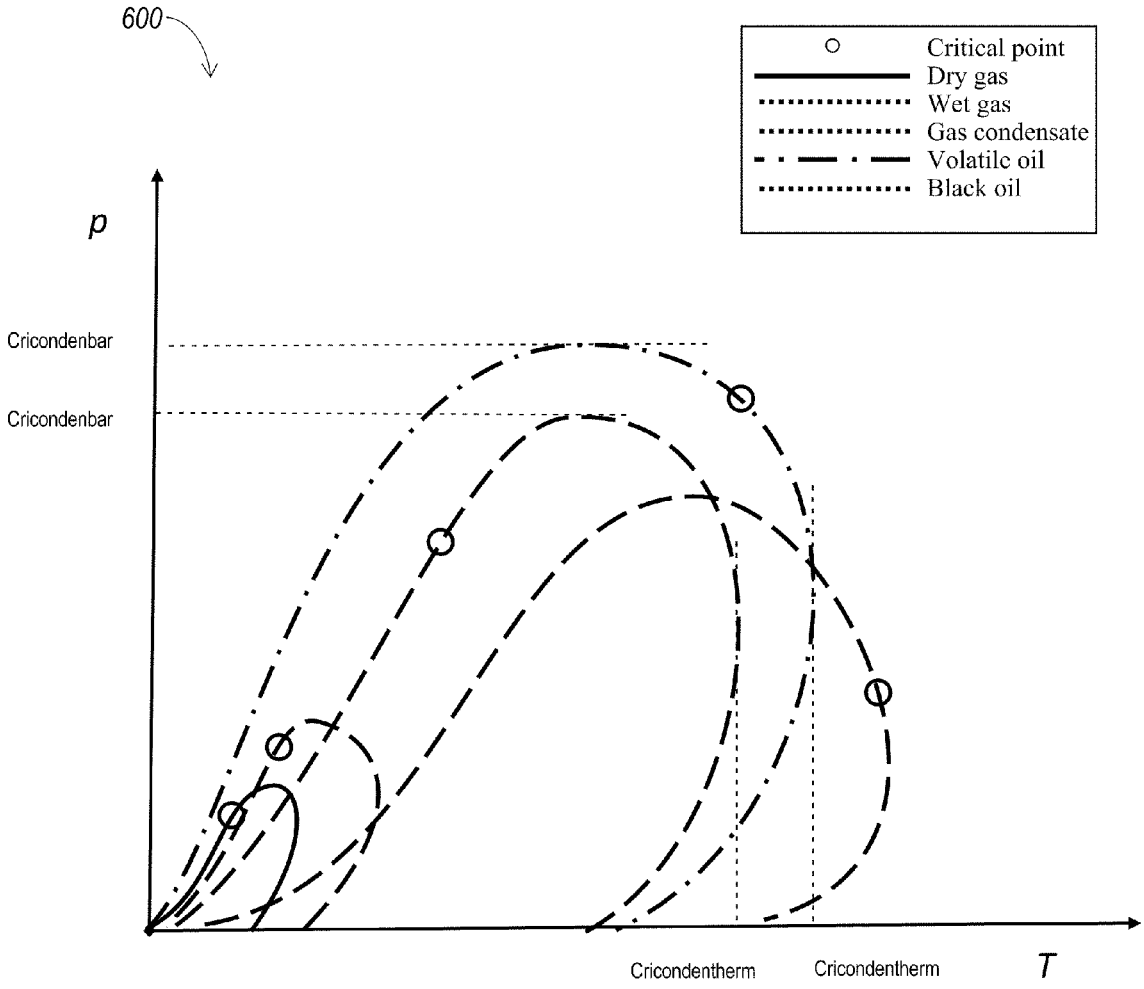
FIG. 8 is a graph of a plurality of example multiphase region envelopes.

FIG. 8 is a graph of a plurality of example multiphase region envelopes in a pressure temperature (p, T) section of phase diagrams. Subterranean formation fluids may include dry gases, wet gases, gas condensates, volatile oils, black oils, and heavy oils. Table 1, as well as characteristics of typical multiphase region envelopes depicted in FIG. 8, may be used to estimate at least a portion of a multiphase region envelope of a fluid sample at the step 860 of the method 800 in FIG. 7.

TABLE 1

| | Phase | GOR (scf/bbl) | Density ($kg/m^3$) at stock tank condition | Oil formation volume factor | C5+ fraction |
|---|---|---|---|---|---|
| Dry gas | gas | — | 700 to 850 | — | ~0.02 |
| Wet gas | | 15,000 to 100,000 | 700 to 740 | — | ~0.11 |
| Gas condensate | | 3,000 to 15,000 | 740 to 780 | — | ~0.23 |
| Volatile Oil | liquid | 2,500 to 3,000 | 780 to 823 | 2 to 4 | ~0.46 |
| Black Oil | | 100 to 2,500 | 825 to 875 | 1 to 2 | ~0.84 |
| Heavy Oil | | <100 | >875 | — | ~1.00 |

For dry and wet gases, the subterranean formation temperature may be higher than the cricondentherm of the gases. With dry gases, a production pathway may not enter the multi phase region, while with wet gases, the production pathway may intersect the dew curve at a temperature lower than of the subterranean formation temperature. Thus, for wet gases, liquid may be present in production tubing and surface facilities.

For gas condensates, the subterranean formation temperature may be higher than the critical temperature, and lower than the cricondentherm of the gas condensates. The production pathway may intersect a dew curve at the temperature of the subterranean formation. Thus, during production, liquids may form within the formation as well as in production tubing and surface facilities. The liquid formed may predominately comprise the higher molar mass compounds and the gas condensates. The amount and/or composition of the liquid phase formed in the formation may depend on the location of the formation pressure and temperature relative to the multiphase region of the gas condensates. For example, the amount and/or composition of the liquid phase may depend on temperature, pressure, and/or chemical composition of the gas condensates. The impact of liquid formed in the formation on production capabilities may be a function of the amount and/or composition of the liquid phase formed in the formation and/or on the formation rock properties.

Gas condensates may be termed retrograde when the dew curve is intersected twice by an isothermal pressure reduction pathway. As the pressure is decreased, liquid may appear at an upper dew point. Further pressure reduction may result in liquid vaporization and eventually, at pressure levels below a lower dew point, the gas retrograde condensate may be in gaseous phase.

For volatile oils, the subterranean formation temperature may be lower than the critical temperature. The production pathway may intersect a bubble curve at the temperature of the subterranean formation. Thus, gas bubbles may evolve in the formation at pressure levels lower than the bubble point.

For black oils, the formation temperature may be significantly lower than the critical temperature. The gas oil ratio (GOR) may be small compared to other fluid types and may result in relatively large volumes of liquid at stock tank conditions.

Heavy oils may be a special case of black oils having an even lower GOR, and may contain predominantly high molecular mass components. Heavy oils may be very viscous (heavy oil viscosity at stock tank conditions may be larger than 10 Pa·s), and therefore, heavy oil may be difficult to produce.

Figure 9:
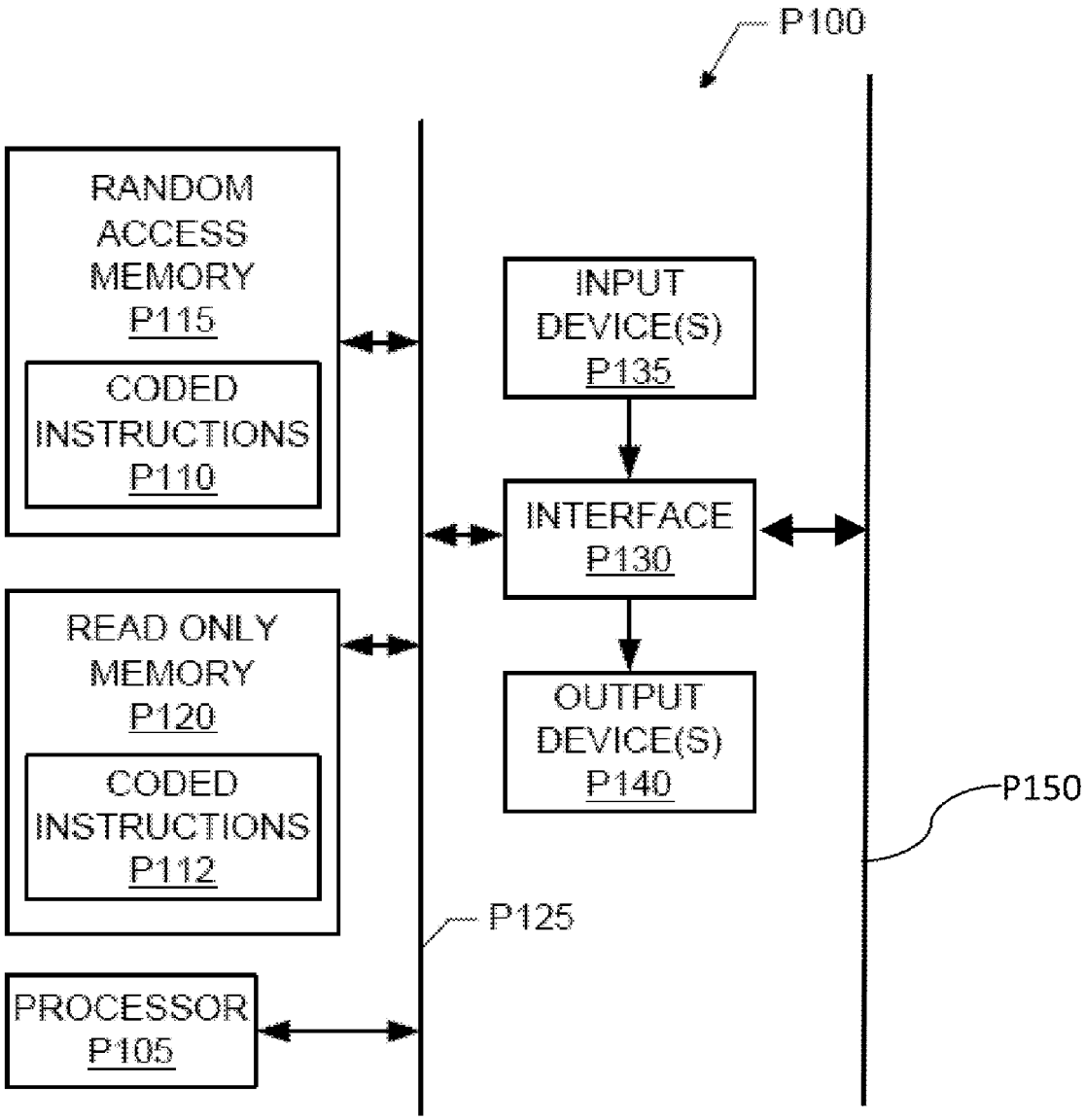
FIG. 9 is a schematic view of at least a portion of a computing system according to one or more aspects of the present disclosure.

FIG. 9 is a schematic view of at least a portion of an example computing system P100 that may be programmed to carry out all or a portion of the methods of the present disclosure. For example, the computing system P100 shown in FIG. 9 may be used to implement surface components (e.g., components located at the Earth's surface) and/or downhole components (e.g., components located in a downhole sampling tool) of a distributed computing system. The computing system P100 may be used to implement all or a portion of the electronics and processing system 206 of FIG. 2, the downhole control system 212 of FIG. 2, the logging and control unit 360 of FIG. 3A, and/or the downhole control system 480 of FIG. 3B.

The computing system P100 may include at least one general-purpose programmable processor P105. The processor P105 may be any type of processing unit, such as a processor core, a processor, a microcontroller, etc. The processor P105 may execute coded instructions P110 and/or P112 present in main memory of the processor P105 (e.g., within a RAM P115 and/or a ROM P120). When executed, the coded instructions P110 and/or P112 may cause the wireline tool 200 of FIG. 2 and/or the sampling-while-drilling device 410 of FIG. 3B to perform at least a portion of the method 500 of FIG. 4, among other things.

The computing system P100 may also include an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example input device P135 may be used, for example, to collect sensor data collected from the fluid sensing unit 220 (in FIG. 2), the fluid isolation and analysis tool 226 (in FIG. 2), the fluid sensing unit 470 (in FIG. 3B) and/or the fluid isolation and analysis tool 490 (in FIG. 3B). The example output device P140 may be used to, for example, display, print and/or store on a removable storage media one or more of a monitored temperature of the portion of the formation, a monitored power used to alter the temperature, and/or determined properties of a subterranean formation fluid.

The processor P105 may be in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to store one or more of a monitored temperature of the portion of the formation, a monitored power used to alter the temperature, and/or determined properties of a subterranean formation fluid, among other things.

Further, the interface circuit P130 may be connected to a telemetry system P150, including, for example, the multiconductor cable 204 of FIG. 6, the mud pulse telemetry (MPT) and/or the wired drill pipe (WDP) telemetry system of FIG. 3A. The telemetry system P150 may be used to transmit measurement data, processed data and/or instructions, among other things, between the surface and downhole components of the distributed computing system.

In view of all of the above and FIGS. 1A to 8, it should be readily apparent to those skilled in the art that the present disclosure provides a method of evaluating a subterranean formation fluid, comprising extracting a first fluid sample from a portion of the subterranean formation, altering a temperature of the portion of the subterranean formation, extracting a second fluid sample from the portion of the subterranean formation having altered temperature, and determining a property of the formation fluid by comparing the first and second fluid samples. Determining the property of the formation fluid and comparing the first and second fluid samples may be performed in situ. Comparing the first and second fluid samples may comprise determining which one of the first and second fluid samples is in single phase. Altering the temperature of the portion of the subterranean formation may comprise heating the portion of the subterranean formation. Altering the temperature of the portion of the subterranean formation may comprise cooling the portion of the subterranean formation. Altering the temperature of the portion of the subterranean formation may comprise analyzing the first fluid sample and altering the temperature may be based on the analysis of the first fluid sample. Analyzing the first fluid sample may comprise determining a first fluid sample temperature, and determining a temperature range of a multiphase region of the first fluid sample. Altering the temperature of the portion of the subterranean formation based on the analysis of the first fluid sample may comprise comparing the first fluid sample temperature and the temperature range. Determining the property of the formation fluid may comprise determining a condensate-to-gas ratio. The method may further comprise monitoring the temperature of the portion of the subterranean formation and detecting a phase transition in the portion of the subterranean formation from the monitored temperature. The method may further comprise monitoring a power used to alter the temperature of the portion of the subterranean formation and detecting a phase transition in the portion of the subterranean formation from the monitored power.

The present disclosure also provides a method of sampling a subterranean formation fluid, comprising determining a formation fluid temperature, determining a temperature range of a multiphase region of the formation fluid, altering a temperature of a portion of the subterranean formation based on a comparison of the determined formation fluid temperature and the determined temperature range, and extracting a fluid sample from the portion of the subterranean formation having altered temperature. Extracting a fluid sample from the portion of the subterranean formation having altered temperature may comprise extracting a second fluid sample, the method further comprising extracting a first fluid sample from the portion of the subterranean formation prior to altering the temperature of the portion of the subterranean. Determining the temperature range may comprise determining composition data of the first fluid sample and estimating at least a portion of a multiphase region envelope from the composition data. The method may further comprise determining a density of the first fluid sample and the at least portion of the multiphase region envelope may further be estimated from the density of the first fluid sample. Determining composition data of the first fluid sample may be performed in-situ. The method may further comprise lowering a pressure of the first fluid sample. The method may further comprise determining an amount of a discrete phase generated by lowering the pressure of the first fluid sample, and determining the temperature range may comprise estimating at least a portion of a multiphase region envelope from the amount of the discrete phase. Determining the temperature range may comprise determining a phase transition pressure of the first fluid sample and estimating at least a portion of a multiphase envelope from the value of the phase transition pressure. Determining the value of the phase transition pressure of the first fluid sample may comprise determining a retrograde dew point. Altering the temperature of the portion of the subterranean formation may comprise increasing the temperature of the portion of the subterranean formation to a temperature higher than a cricondentherm of the formation fluid. Altering the temperature of the portion of the subterranean formation may comprise radiating microwaves in the portion of the subterranean formation to heat water in the portion of the subterranean formation. Altering the temperature of the portion of the subterranean formation may comprise applying a heated pad on a wellbore wall to convect heat into the portion of the subterranean formation. Altering the temperature of the portion of the subterranean formation may comprise circulating a fluid in the wellbore to lower the temperature. The method may further comprise determining a property of the fluid sample. Determining the property of the formation fluid may comprise determining a condensate-to-gas ratio.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method of evaluating a subterranean formation fluid, comprising:

extracting a first fluid sample from a portion of the subterranean formation;

altering a temperature of the portion of the subterranean formation;

extracting a second fluid sample from the portion of the subterranean formation having altered temperature;

determining a property of the formation fluid by comparing the first and second fluid samples; and monitoring the temperature of the portion of the subterranean formation and detecting a phase transition in the portion of the subterranean formation from the monitored temperature.

2. The method of claim 1 wherein determining the property of the formation fluid and comparing the first and second fluid samples are performed in situ.

3. The method of claim 1 wherein comparing the first and second fluid samples comprises determining which one of the first and second fluid samples is in single phase.

4. The method of claim 1 wherein altering the temperature of the portion of the subterranean formation comprises heating the portion of the subterranean formation.

5. The method of claim 1 wherein altering the temperature of the portion of the subterranean formation comprises analyzing the first fluid sample and wherein altering the temperature is based on the analysis of the first fluid sample.

6. The method of claim 5 wherein analyzing the first fluid sample comprises:

determining a first fluid sample temperature; and determining a temperature range of a multiphase region of the first fluid sample.

7. The method of claim 6 wherein altering the temperature of the portion of the subterranean formation based on the analysis of the first fluid sample comprises comparing the first fluid sample temperature and the temperature range.

8. The method of claim 1 wherein determining the property of the formation fluid comprises determining a condensate-to-gas ratio.

9. The method of claim 1 further comprising monitoring a power used to alter the temperature of the portion of the subterranean formation and detecting a phase transition in the portion of the subterranean formation from the monitored power.

10. A method of evaluating a subterranean formation fluid, comprising:

extracting a first fluid sample from a portion of the subterranean formation;

altering a temperature of the portion of the subterranean formation;

extracting a second fluid sample from the portion of the subterranean formation having altered temperature; and determining a property of the formation fluid by comparing the first and second fluid samples wherein altering the temperature of the portion of the subterranean formation comprises cooling the portion of the subterranean formation.

11. A method of sampling a subterranean formation fluid, comprising:

determining a formation fluid temperature;

determining a temperature range of a multiphase region of the formation fluid wherein determining the temperature range comprises determining a phase transition pressure of a first fluid sample and estimating at least a portion of a multiphase envelope from the value of the phase transition pressure;

altering a temperature of a portion of the subterranean formation based on a comparison of the determined formation fluid temperature and the determined temperature range;

extracting the first fluid sample from the portion of the subterranean formation having altered temperature prior to altering the temperature of the portion of the subterranean formation; and extracting a second fluid sample from the portion of the subterranean formation having altered temperature.

12. The method of claim 11 wherein determining the temperature range comprises determining composition data of the first fluid sample and estimating at least a portion of a multiphase region envelope from the composition data.

13. The method of claim 12 further comprising determining a density of the first fluid sample and wherein the at least portion of the multiphase region envelope is further estimated from the density of the first fluid sample.

14. The method of claim 12 wherein determining composition data of the first fluid sample is performed in-situ.

15. The method of claim 11 further comprising lowering a pressure of the first fluid sample.

16. The method of claim 15 further comprising:

determining an amount of a discrete phase generated by lowering the pressure of the first fluid sample; and wherein determining the temperature range comprises estimating at least a portion of a multiphase region envelope from the amount of the discrete phase.

17. The method of claim 11 wherein determining the value of the phase transition pressure of the first fluid sample comprises determining a retrograde dew point.

18. The method of claim 11 wherein altering the temperature of the portion of the subterranean formation comprises increasing the temperature of the portion of the subterranean formation to a temperature higher than a cricondentherm of the formation fluid.

19. The method of claim 11 wherein altering the temperature of the portion of the subterranean formation comprises radiating microwaves in the portion of the subterranean formation to heat water in the portion of the subterranean formation.

20. The method of claim 11 wherein altering the temperature of the portion of the subterranean formation comprises applying a heated pad on a wellbore wall to convect heat into the portion of the subterranean formation.

21. The method of claim 11 wherein altering the temperature of the portion of the subterranean formation comprises circulating a fluid in the wellbore to lower the temperature.

22. The method of claim 11 further comprising determining a property of the second fluid sample.

23. The method of claim 22 wherein determining the property of the formation fluid comprises determining a condensate-to-gas ratio.

* * * * *